US010501154B2

(12) United States Patent
Brezina

(10) Patent No.: US 10,501,154 B2
(45) Date of Patent: Dec. 10, 2019

(54) HORN CLEAT DEFLECTOR

(71) Applicant: David C Brezina, Chicago, IL (US)

(72) Inventor: David C Brezina, Chicago, IL (US)

( * ) Notice: Subject to any disclaimer, the term of this patent is extended or adjusted under 35 U.S.C. 154(b) by 0 days.

(21) Appl. No.: 15/871,717

(22) Filed: Jan. 15, 2018

(65) Prior Publication Data

US 2019/0217925 A1 Jul. 18, 2019

(51) Int. Cl.
*B63B 21/04* (2006.01)
*B63B 17/00* (2006.01)

(52) U.S. Cl.
CPC ..... *B63B 21/045* (2013.01); *B63B 17/00* (2013.01)

(58) Field of Classification Search
CPC ..... B63B 21/045; B63B 21/04
USPC ..... 114/218
See application file for complete search history.

(56) References Cited

U.S. PATENT DOCUMENTS

| | | | | |
|---|---|---|---|---|
| 554,228 | A | 2/1896 | Beckwith | |
| 1,770,967 | A | 8/1928 | Bean | |
| D140,381 | S | 10/1944 | Anderson | |
| 3,110,046 | A | 11/1963 | Fischer | |
| D250,571 | S | 12/1978 | Winslow | |
| 4,173,194 | A | 11/1979 | McLaughlin | |
| 4,685,500 | A * | 8/1987 | Silvia | B63B 21/045 114/218 |
| 5,327,844 | A | 7/1994 | Kress | |
| 5,826,531 | A | 10/1998 | Havnaer | |
| 6,125,779 | A | 10/2000 | Czipri | |
| 6,769,375 | B1 | 8/2004 | Caporella | |
| 2013/0152841 | A1 | 6/2013 | Moen | |

OTHER PUBLICATIONS

Annapolis Performance Sailing, Cleat Chock—Pair, Jan. 2018, Annapolis, MD, http://www.apsltd.com/cleat-chocks-pair.html.
www.solvingideas.com, Cleat Cover, Jan. 10, 2018.

* cited by examiner

*Primary Examiner* — Andrew Polay

(57) ABSTRACT

A horn cleat deflector assembly uses a pair of bodies to engage the horns of a horn cleat top surfaces engaging the ends of horns, flat surfaces engaging the deck and an angled surface deflecting external objects from fouling the cleat, inner surfaces providing clearance to permit a line to be fastened to the cleat with a lanyard adapted to retain the bodies in position.

9 Claims, 2 Drawing Sheets

HORN CLEAT DEFLECTOR

CROSS-REFERENCE TO RELATED APPLICATIONS

No related applications.

STATEMENT REGARDING FEDERALLY SPONSORED RESEARCH OR DEVELOPMENT

No sponsored research or development.

THE NAMES OF THE PARTIES TO A JOINT RESEARCH AGREEMENT

No joint research agreement,

BACKGROUND OF THE INVENTION

Horn cleats are a well known apparatus used for connecting two items using an elongated flexible members such as a lines formed of rope. Horn cleats have well known benefits including reliability, simplicity and ease of use to receive, by bending and hitching, the elongated flexible, tension members for purposes such as mooring a vessel, towing a vessel or securing control lines. Other uses can include securing jacklines of webbing or woven tubing, the jacklines providing an attachment for crew tethers permitting crew to move fore and aft while their tether remains attached, the attachment shackle or carabiner sliding on the jackline.

However, while robust and time-tested for securing lines such as described, the exposed horns have the undesirable property of fouling items whose contact with retention by the cleat is not wanted. Unwanted fouling of items can include several examples. Control lines such as spinnaker or other sail sheets that are desired to run free can foul inadvertently, disrupting sail setting and trimming. Toes of crew walking, or other body parts of crew sitting or moving using their hands, or clothing can get caught causing discomfort or even injury. Attachment shackles or carabiners slidably connected to jacklines can jam.

BRIEF SUMMARY OF THE INVENTION

A horn cleat deflector assembly works with a horn cleat having a base and typically opposed projecting horns, the cleat typically being mounted to a deck. A horn cleat deflector body has a lower surface for contacting the deck. An inner surface provides clearance adjacent the base of the cleat and root of the horn to permit a line to be fastened.

The horn cleat deflector body has a top surface that contacts the underside of horn to closing the space between the horn and deck. Side surfaces may have lanyard holes or attachments. An angled outer surface deflects an item moving along the deck, whether control line, toes or shackles, so that the item does not foul under the cleat horn.

DETAILED DESCRIPTION OF THE INVENTION

Figures 1, 2, 3, 4, 5, 6, 7, 8, 9:
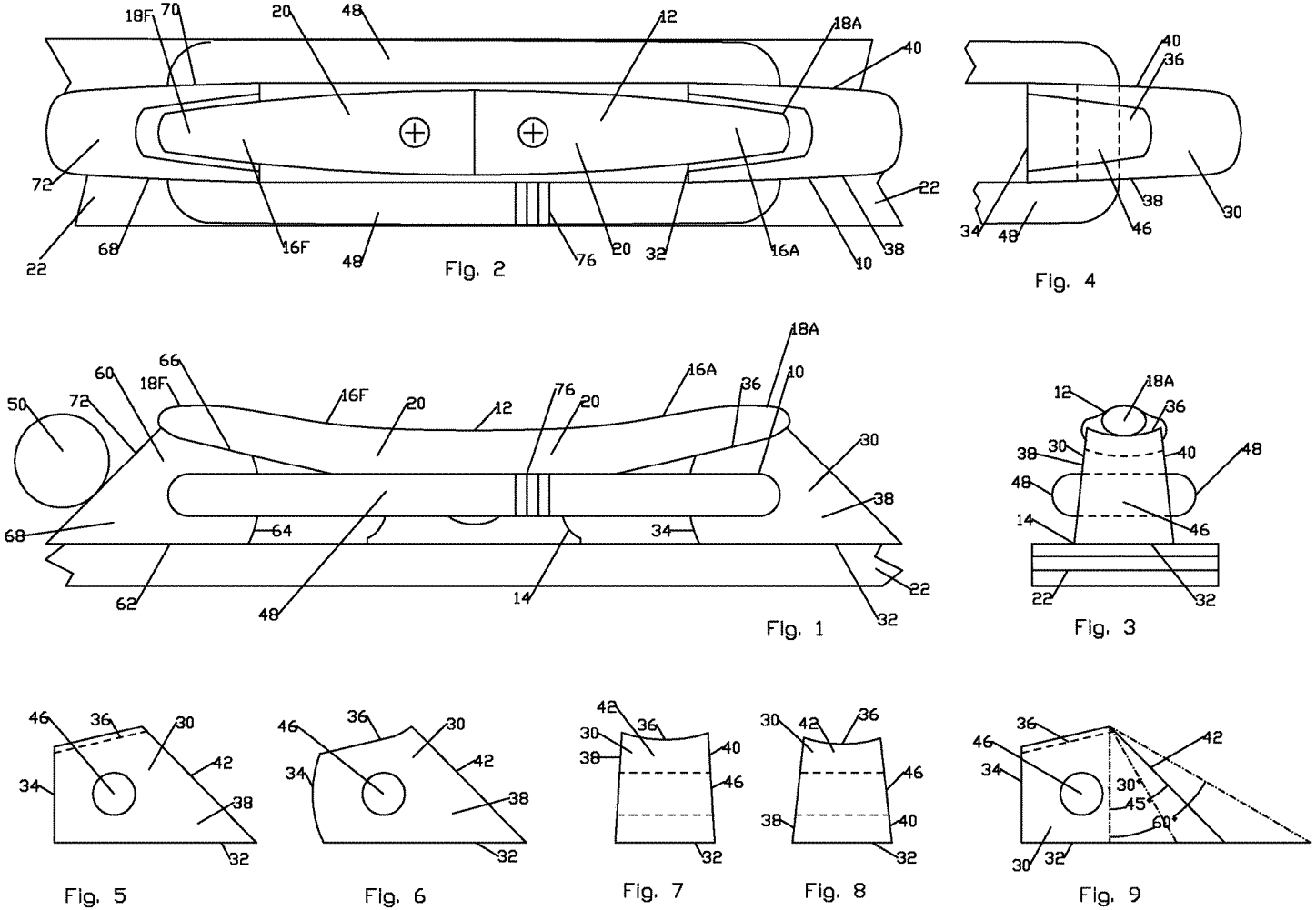
FIG. 1 is a side elevation of the horn cleat deflector assembly on a horn cleat.
FIG. 2 is a top plan view of the horn cleat deflector assembly on a horn cleat.
FIG. 3 is an end elevation of the horn cleat deflector assembly on a horn cleat.
FIG. 4 is a top plan view of the horn cleat deflector body.
FIG. 5 is a side elevation of the horn cleat deflector body in unfitted condition.
FIG. 6 is a side elevation of the horn cleat deflector body in fitted condition.
FIG. 7 is an end elevation of the horn cleat deflector body in unfitted condition.
FIG. 8 is an end elevation of the horn cleat deflector body in fitted condition.
FIG. 9 is a side elevation of the horn cleat deflector body in unfitted condition showing preferred angles.

A horn cleat deflector assembly, 10, works with a horn cleat, 12, having a base, 14, at least one projecting horn, 16, the horn, 16 having an outer end, 18, and root end, 20, proximate the base, 14. Cleat, 12, is mounted to a structure, 22, typically a deck.

Horn cleat deflector assembly, 10, has a body 30 with a first lower surface, 32, for contacting structure, 22, a first inner surface, 34, formed and arranged to provide clearance adjacent base, 14, and root end, 20, typically to permit an elongated tension member, such as a line formed of rope, webbing or woven tubing.

Horn cleat shoe body, 30, has a first top surface, 36, that, when in use, contacts the underside of horn, 16A. Horn cleat shoe body, 30, has first side surface, 38, and second side surface, 40, oriented substantially parallel to a long axis of cleat, 12, extending at least from end, 18, to base, 14, and typically to a distal end 18A on a cleat, 12, having fore and aft ends, 18F and 18A, on fore and aft horns, 16F and 16A.

Horn cleat deflector assembly, 10, has a first angled outer surface, 42, formed and arranged so that external items, 50, will not catch or foul on horns, 18F or 18A. In use, horn cleats, 12, receive, by bending and hitching, elongated flexible tension members such as lines formed of rope. The lines may be used, for example, for mooring a vessel, towing a vessel, or securing control lines. Cleats, 12, may be used for securing jacklines of webbing or woven tubing, the jacklines providing an attachment for crew tethers permitting crew to move fore and aft while their tether remains attached, the attachment shackle or carabiner sliding on the jackline. In addition to well understood undesirable properties like fouled control lines and stubbed toes, in the case of jacklines and tethers, a shackle or carabiner can become mechanically lodged between a horn, 16F or 16A, and a structure, 22, such as a deck, thereby causing damage to the shackle or carabiner, resulting in unwanted detachment.

Several arrangements of body, 30, could be suitable. In one embodiment, body, 30, is formed entirely of a resilient material, 44, such as a solid elastomer, or an elastomeric foam. In a composite embodiment, resilient material, 44, could have angled outer surface, 42, formed of a harder, more durable material, perhaps having less friction than resilient material, 44, to provide greater durability when contacted with harder objects. Another alternative could be to have the body, 30, formed of a generally harder material, with a resilient material, 44, applied as sheets to one or both of lower surface, 32, and top surface, 36.

Body, 30, is preferably provide with lanyard aperture, 46, although different lanyard attachment structures, such as screws, bolts, rivets, or eyes could be used to attach lanyard, 48, permitting body, 30, to be maintained in a desired location. Lanyard, 48, may be an elastic loop, or may have ends fastenable through tying or using various connectors such as clips, buckles or hook and loop fasteners.

When body, 30, is in place between horn, 16, and structure, 22, external items, 50, whether control lines, body parts or mechanical parts such as shackles or carabiners, are urged upward by angled outer surface 42 to pass over horn, 16.

Assembly 10 is completed having second shoe body, 60, with second lower surface, 62, second inner surface, 64, second top surface, 66, third side surface, 68, fourth side surface, 70, second angled outer surface, 72, second lanyard aperture, 74, and lanyard connector, 76, as a mirror image of body 30. Body, 60, fits under second horn 16F and between horn 16F and structure 22. Lanyard 46 can interconnect body 30 and body 60.

As shown and described with respect to body 30, body 60 may be formed as a composite with resilient material and a harder composite angled surface.

Lanyard configuration may be a factor in securing assembly 10 and in ease of use. A loop would require that a line pass through the loop before placing assembly on cleat, 12, because the line should be secured before assembly is put in place. A disconnectable and connectable lanyard, 48, would permit assembly, 10, to be placed on cleat, 12, after the line is secured. Connector, 76, could be disconnected to fit over a cleat, 12, with a belayed line, 90, and assembly, 10, fitted and lanyard, 48, reconnected at connector, 76.

The angled outer surfaces, 42, 72, would preferably be formed and arranged at about forty five degrees (45°). An angle of less than about thirty degrees (30°) would have an insufficient vertical component, while an angle of greater than about sixty degrees (60°) would intrude too far onto deck space. It will be understood that if body, 30, 60, is formed of resilient material, the precise angle may vary depending on the state of compression of the material.

Figure 10:
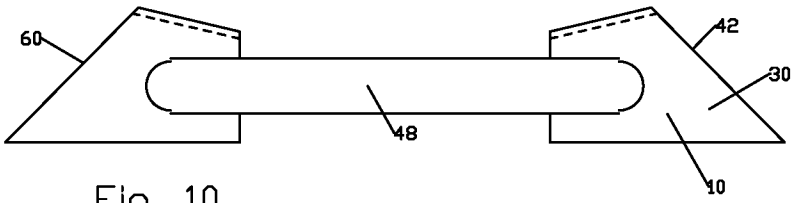
FIG. 10 is a side elevation of the horn cleat deflector assembly in unfitted condition.
Figure 11:
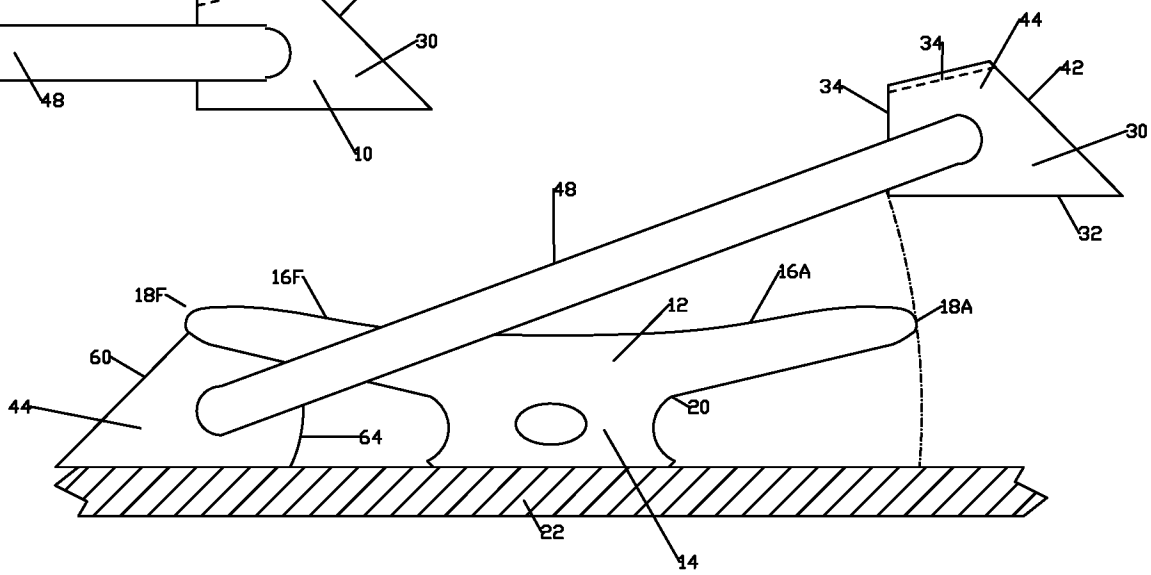
FIG. 11 is a side elevation of the horn cleat deflector assembly being fitted to a cleat.
Figure 13:
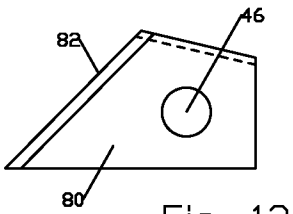
FIG. 13 is a side elevation of the horn cleat body having a composite construction.
Figure 12:
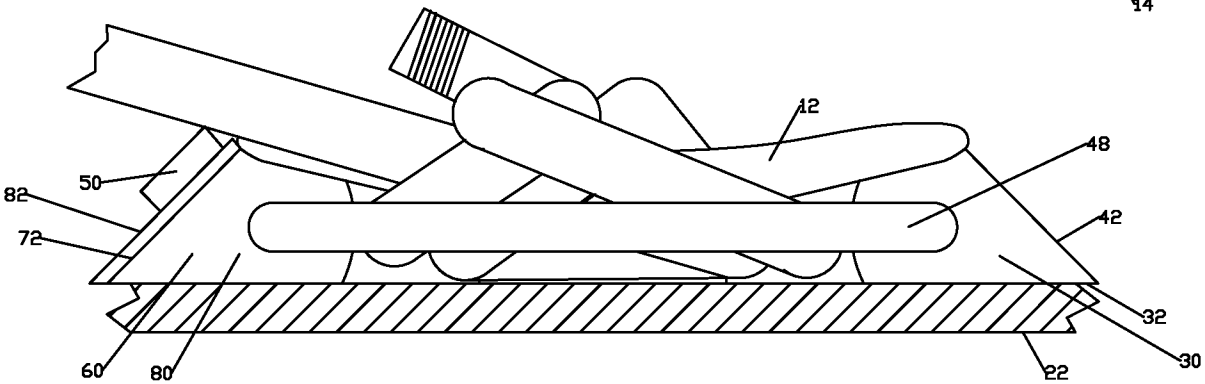
FIG. 12 is a side elevation of the horn cleat deflector assembly fitted to a cleat showing a line fastened to the cleat.

FIG. 10, FIG. 11 and FIG. 12 show the steps to fit a horn cleat deflector assembly, 10, to a cleat, 12. In FIG. 10 assembly, 10, is unfitted, and if formed of elastic bodies, 30, 60, and elastic lanyard, 48, the assembly is unstretched. In FIG. 11, second body, 60, is fitted to horn 18F, lanyard, 48 is stretched and body, 30 is pulled over end 18A so as to engage horn, 16A, and structure, 22. When tension on lanyard 48 is released, bodies, 30, 60, would be in the position of FIG. 1.

If either a loop lanyard, 48, or a disconnectable lanyard, 48, the assembly, 10, could be fitted over an elongated tension member 90, such as a line, belayed to cleat, 12. As described above, the line could pass through a loop lanyard, 48, or conntectable lanyard, 48, could be connected after assembly, 10, is fitted over a belayed line, 90.

In accordance with my invention I claim:

1. A horn cleat deflector assembly for reducing fouling on a horn cleat having a base and at least one projecting horn with an outer end and a root end, the base being mounted to a structure, the horn cleat deflector assembly comprising:

a first shoe body having a first lower surface, a first inner surface, a first top surface, first and second side surfaces and a first angled outer surface;

said first lower surface contacts said structure;

said first inner surface faces said base;

said first top surface contacts said horn;

said first and second opposed side surfaces substantially perpendicular to said lower surface and said top surface;

said first angled outer surface is formed and arranged so that external items moving towards said horn are urged in a direction away from said structure;

said first shoe body is formed of a resilient material that compresses and distorts as said top surface contacts said horn and said shoe body is urged in the direction from said outer end and said root end;

said first shoe body, when compressed, is retained between said horn and said structure;

said first shoe body has a lanyard aperture extending through said body from first and second opposed side surfaces;

a lanyard is fitted to said first aperture to urge said as said top surface in contact with said horn as said shoe body is urged in the direction from said outer end and said root end;

a second shoe body formed and arranged as a mirror image of said first shoe body;

said second shoe body having a second lower surface, a second inner surface, a second top surface, third and fourth side surfaces and a second angled outer surface;

said second lower surface contacts said structure;

said second inner surface faces said base;

said second top surface contacts said horn;

said third and fourth opposed side surfaces substantially perpendicular to said lower surface and said top surface;

said second angled outer surface is formed and arranged so that external items moving towards said horn are urged in a direction away from said structure;

said second shoe body is formed of a resilient material that compresses and distorts as said top surface contacts said horn and said shoe body is urged in the direction from said outer end and said root end;

said second shoe body, when compressed, is retained between said horn and said structure;

said second shoe body has a lanyard aperture extending through said body from first and second opposed side surfaces;

said first shoe body and said second shoe body transversely capturing the horn cleat when horn cleat has two projecting horns being a first projecting horn and a second projecting horn;

said first top surface and said second top surface are concave to facilitate contact with the first and second horns;

said horn cleat with two projecting horns vertically capturing said first and second shoe bodies between said first and second horns and said structure;

said lanyard interconnecting said first and second shoe bodies so as to extend to clear said first and second horns and compressing to urge said shoe and horn engagement;

said first angled surface and said second angled surface are aligned at between thirty degrees (30°) and sixty degrees (60°) relative to said first and second lower surfaces.

2. A horn cleat deflector assembly for reducing fouling on a horn cleat having a base and at least one projecting horn with an outer end and a root end, the base being mounted to a structure, the horn cleat deflector assembly comprising:

a shoe body having a lower surface, an inner surface, a top surface and an angled outer surface;

said lower surface contacts said structure;

said inner surface faces said base;

said top surface contacts said horn;

first and second opposed side surfaces substantially perpendicular to said lower surface and said top surface;

said angled outer surface is formed and arranged so that external items moving towards said horn are urged in a direction away from said structure;

said shoe body is formed of a resilient material that compresses and distorts as said top surface contacts said horn and said shoe body is urged in the direction from said outer end and said root end;

said shoe body, when compressed, is retained between said horn and said structure;

said shoe body has a lanyard aperture extending through said body from first and second opposed side surfaces.

3. The deflector assembly of claim 2 further comprising:

said top surface is concave to facilitate contact with said horn.

4. The deflector assembly of claim 2 further comprising:

a lanyard is fitted to said shoe body to urge said as said top surface in contact with said horn as said shoe body is urged in the direction from said outer end and said root end.

5. The deflector assembly of claim 4 further comprising:

said lanyard being a resilient lanyard interconnecting said first and second shoe bodies so as to extend to clear said first and second horns and compressing to urge said shoe and horn engagement.

6. The deflector assembly of claim 2 further comprising:

said shoe body being a first shoe body;

a second shoe body formed and arranged as a mirror image of said first shoe body;

said first shoe body and second shoe body transversely capturing the horn cleat when horn cleat has two projecting horns being a first projecting horn and a second projecting horn;

said horn cleat with two projecting horns vertically capturing said first and second shoe bodies between said first and second horns and said structure.

7. The deflector assembly of claim 6 further comprising:

said first shoe body and said second shoe body are formed of a resilient material that compresses and distorts as said top surface contacts said first horn and second horn, said first shoe body and said second shoe body are urged in the direction from said first and second outer ends and said first and second root ends;

said first shoe body and said second hoe body are, when compressed, are retained between said horn and said structure.

8. The deflector assembly of claim 6 further comprising:

said first angled surface and said second angled surface are aligned at between thirty degrees (30°) and sixty degrees (60°) relative to said first and second lower surfaces.

9. The deflector assembly of claim 2 further comprising:

said first angled surface and said second angled surface are aligned at between thirty degrees (30°) and sixty degrees (60°) relative to said first and second lower surfaces.

* * * * *